United States Patent [19]

Bell

[11] Patent Number: 5,052,674

[45] Date of Patent: Oct. 1, 1991

[54] PAPER FEEDER APPARATUS

[75] Inventor: Conrad J. Bell, Webster, N.Y.

[73] Assignee: Xerox Corporation, Stamford, Conn.

[21] Appl. No.: 359,611

[22] Filed: Jun. 1, 1989

[51] Int. Cl.[5] ..... B65H 3/00

[52] U.S. Cl. ..... 271/42; 271/9; 221/97; 221/245; 221/259; 221/273; 221/281

[58] Field of Search ..... 271/18, 42, 9; 221/97, 221/245, 259, 270, 273, 272, 281; 355/309

[56] References Cited

U.S. PATENT DOCUMENTS

| | | | |
|---|---|---|---|
| 3,008,606 | 11/1961 | Limberger | 271/42 X |
| 3,023,931 | 3/1962 | Carlson | 221/259 X |
| 3,195,886 | 7/1965 | Houver | 271/42 |
| 4,071,165 | 1/1978 | Leopoldi | 271/42 X |

OTHER PUBLICATIONS

Standard Xerography Master Making Equipment Operation Manual, pp. 1 & 4.

*Primary Examiner*—David H. Bollinger
*Attorney, Agent, or Firm*—William A. Henry

[57] ABSTRACT

A simple, low cost, hand operated paper feeder includes a media chamber mounted at an acute angle with respect to a horizontal plane that allows media to exit the chamber through a membrane. A two-position, T-shaped actuator including a pair of non-rotating rolls is slidably mounted on a rail for contacting the media. A rod is connected to the actuator such that when movement of the rod is initiated in a first direction, the actuator is moved to a position contacting the media and with continued movement of the rod, a top sheet of the media is moved a predetermined amount through the membrane, and with return of the rod in a second direction to its initial position, the actuator is caused to retract from the media surface to its initial position.

14 Claims, 4 Drawing Sheets

PAPER FEEDER APPARATUS

This invention relates to printing machines, and more particularly, to a paper feeder apparatus to be used in such a machine.

In the art of xerography or other similar image reproducing arts, a latent electrostatic image is formed on a charge-retentive surface such as a photoconductor which generally comprises a photoconductive insulating material adhered to a conductive backing. This photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as toner which forms the visible images is transferred to plain paper.

It should be understood that for the purpose of the present invention, the latent electrostatic image may be generated from information electronically stored or generated, and the digital information may be converted to alphanumeric images by image generation electronics and optics. However, such image generation electronic and optic devices form no part of the present invention.

Paper feeders are used with automated drive rolls throughout the industry in conjunction with printers or copiers of the type just discussed in order to feed copy sheets at a high rate of speed and thereby increase the throughput of the machines. These feeders are costly, cumbersome and quite complicated when evaluated for use in feeding sheets in low cost, slow speed machines. It has become increasingly common to feed copy sheets in some of these machines measuring 24, 36 or 48×36, however, use of prior sheet feeders for this application has been costly and difficult at best. One attempt in the past at feeding sheets economically is shown in the Xerox Model D No. 4 Xerographic Flat Plate machine. Copy sheets are manually fed by pulling a lever in front of the machine that is connected to a ratchet controlled feed roll assembly that is resting on top of a stack of sheets in a feed tray. The ratchet mechanism will not allow the feed rolls to rotate as they are pulled over the top of sheets in the tray. Once a sheet is pulled forward by use of the lever and feed rolls, the lever is released with the ratcheting causing the feed rolls to rotate in a reverse direction so as to not disturb the sheets remaining in the stack. This procedure is repeated for each sheet that is fed. Replenishing of the copy sheets is a major drawback to this type of feeding. The feed tray is positioned in a horizontal plane and has to be loaded from the outside the machine. First, the tray has to be removed from the machine, then the top of the tray opened. Next, the feed roll assembly is lifted up and rotated toward the back of the tray. Paper can then be added to the tray. As one can appreciate, this loading procedure would be especially cumbersome and difficult when handling sheets measuring 24 ×36.

Accordingly, a simple, low cost, hand operated media feeder is disclosed that includes a media chamber mounted at an acute angle with respect to a horizontal plane that allows media to exit through a membrane; two position, T-shaped actuator means including a pair of non-rotating friction means mounted thereon for contacting said media; rail means for slidably supporting said actuator means; and rod means connected to said actuator means such that when movement of said rod means is initiated in a first direction, said actuator means is moved to a position contacting said media and wherein continued movement of said rod means causes a top sheet of said media to be moved a predetermined amount through said membrane, and wherein return of said rod means in a second direction to its initial position causes said actuator means to retract from said media surface to its initial position. Replenishment of copy paper is accomplished by simply opening a door in the from of the copy sheet tray, sliding copy paper into the feed tray chamber and closing the door.

Figure 3:
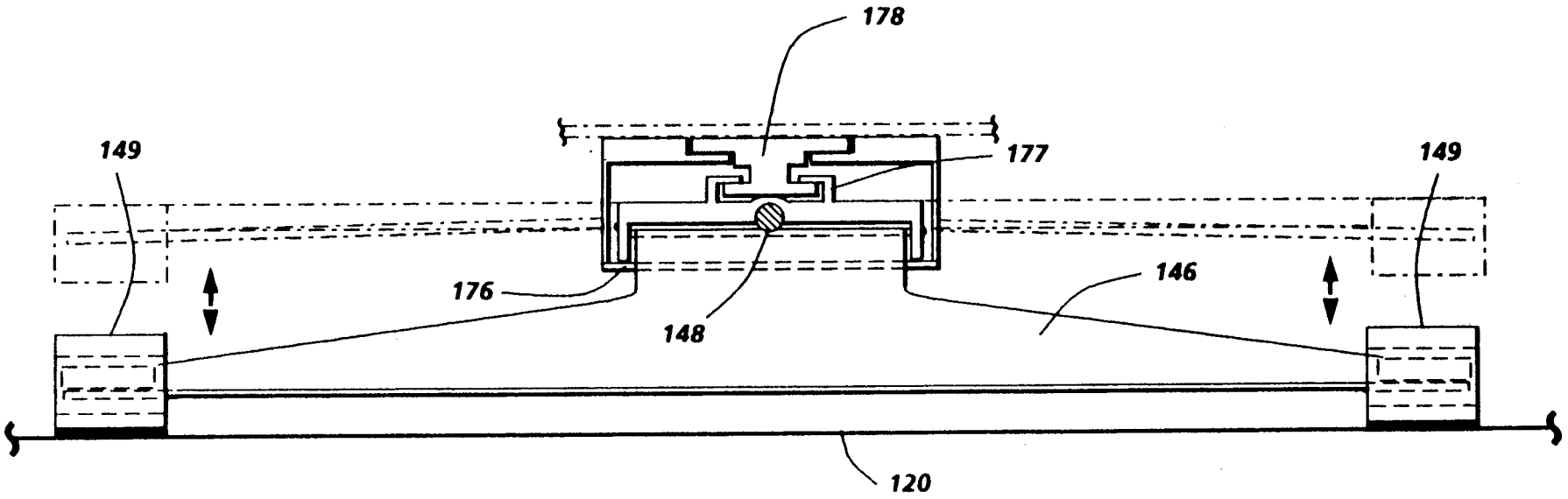
FIG. 3 is a partial front elevational view of the paper feeder structure of FIG. 2.
Figure 4A:
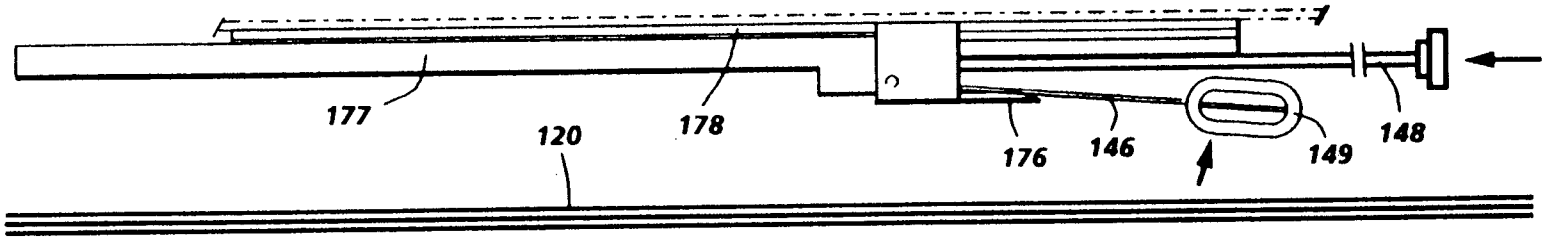
Figure 4B:
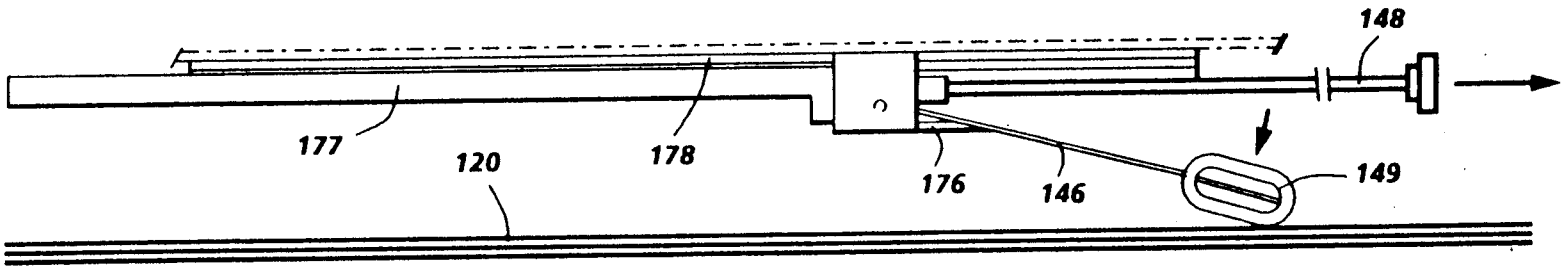
Figure 4C:
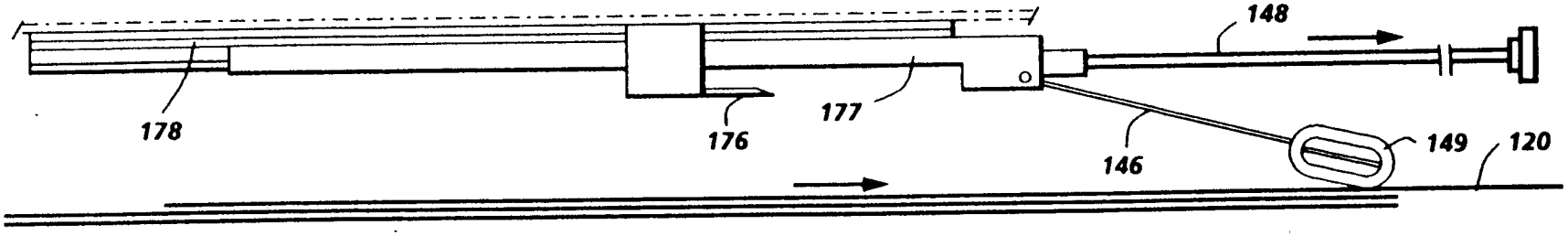

FIGS. 4*a*–4*c* are partial side elevations of the paper feeder of FIG. 3 depicting the paper feeding sequence of the paper feeder.

Figure 1:
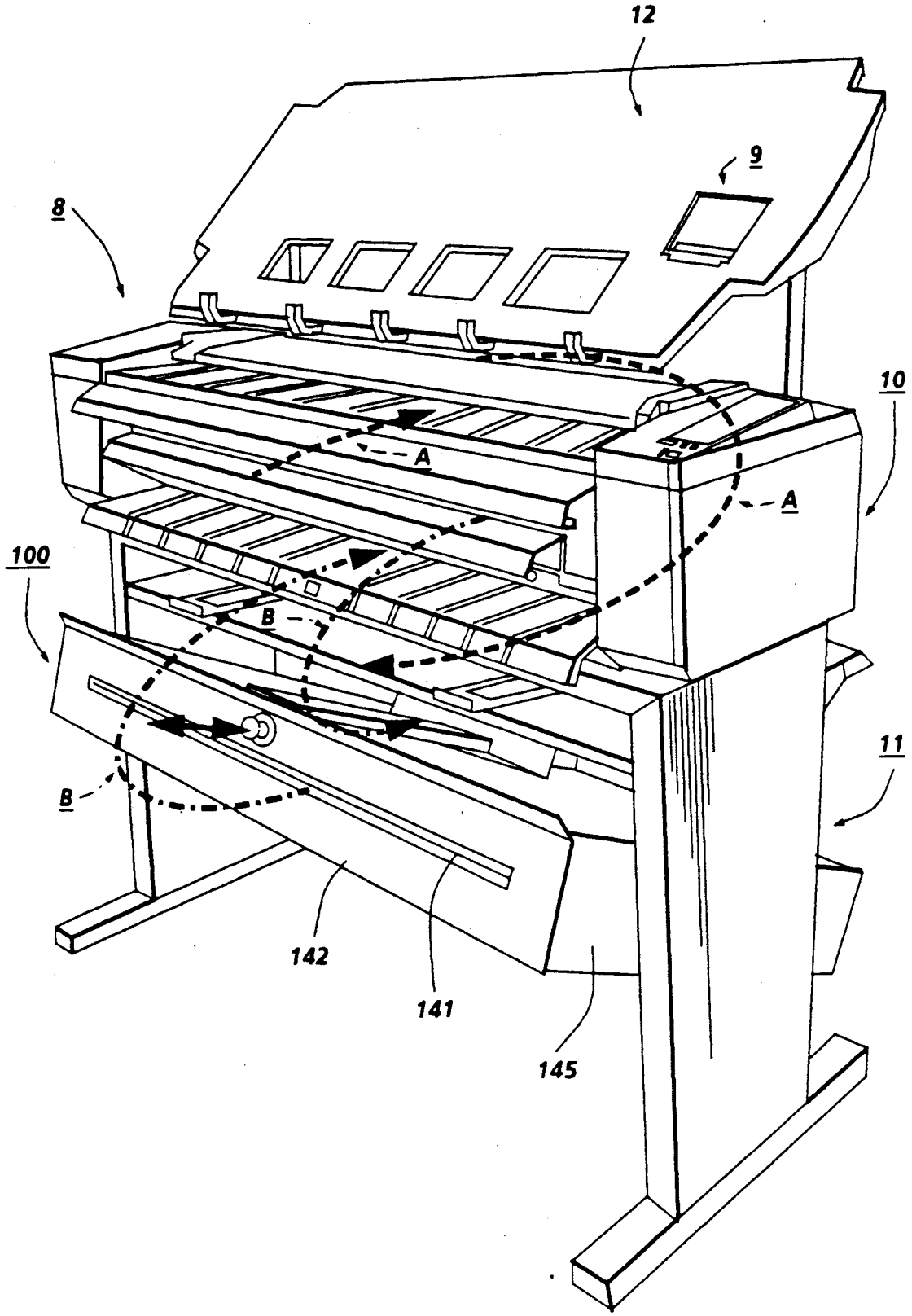
FIG. 1 is an isometric view of a machine incorporating the features of the present invention.
Figure 2:
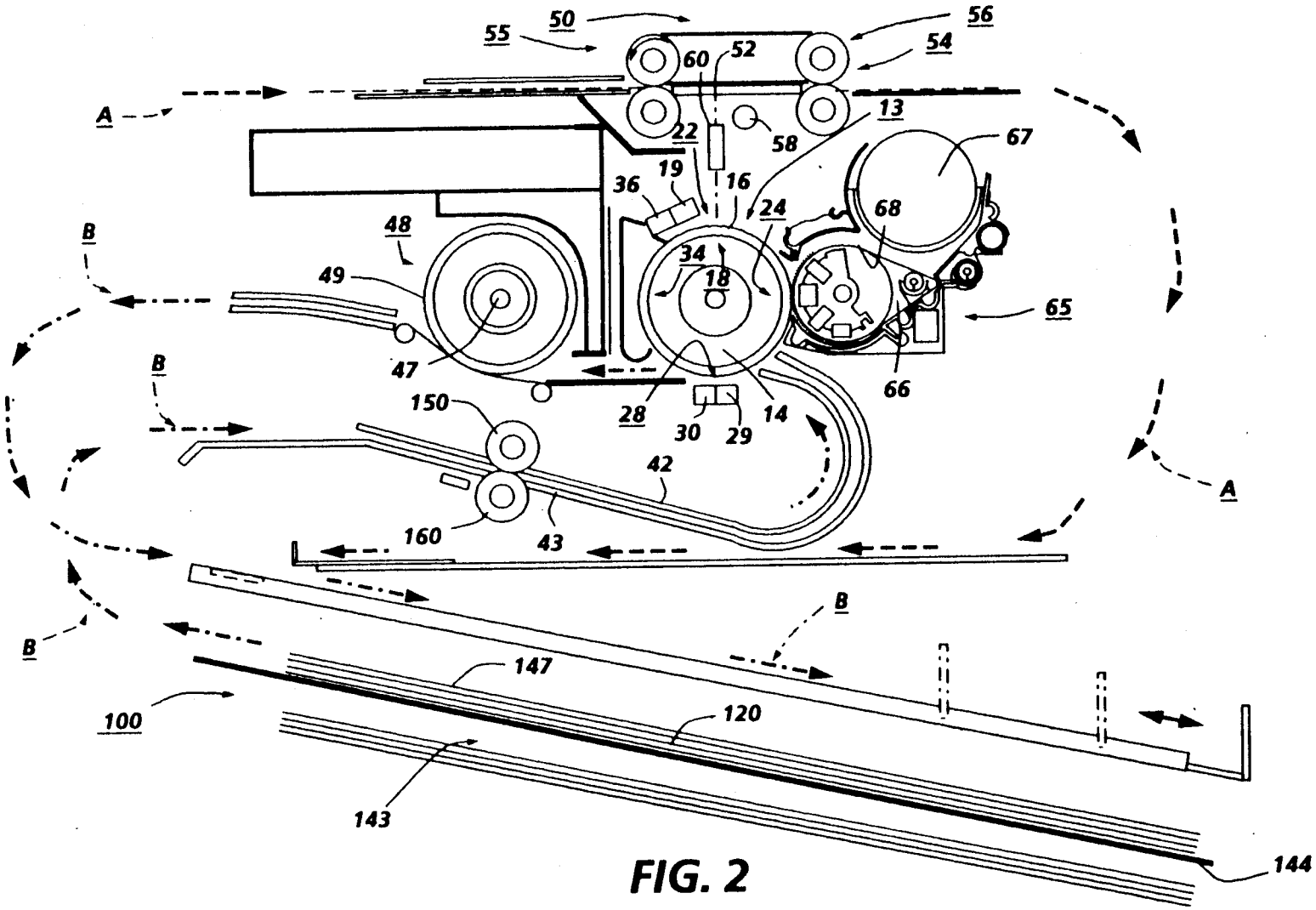
FIG. 2 is a side view schematic of the machine of FIG. 1 showing the present invention.

Referring to FIGS. 1 and 2 of the drawings there is shown by way of example an automatic xerographic reproduction or printing machine, designated generally by the numeral 8 incorporating the idler structure of the present invention.

Machine 8 has a suitable frame or housing 10 within which the machine xerographic section 13 is operatively supported. The xerographic section 13 is supported by stand 11. A document organizer 12 is attached to the frame 11 and includes a flip-type operation instruction manual 9. Briefly, and as will be familiar to those skilled in the art, the machine xerographic section 13 includes a recording member, shown here in the form of a rotatable photoreceptor 14. In the exemplary arrangement shown, photoreceptor 14 comprises a drum having a photoconductive surface 16. Other photoreceptor types such as belt, web, etc. may instead be contemplated. Operatively disposed about the periphery of photoreceptor 14 are charge station 18 with charge corotron 19 for placing a uniform charge on the photoconductive surface 16 of photoreceptor 14, exposure station 22 where the previously charged photoconductive surface 16 is exposed to image rays of the document 9 being copied or reproduced, development station 24 where the latent electrostatic image created on photoconductive surface 16 is developed by toner, transfer station 28 with transfer corotrons 29, 30 for transferring the developed image to a suitable copy substrate material such as a copy sheet 120 brought forward in timed relation with the developed image on photoconductive surface 16, and cleaning station 34 that could include a cleaning blade and discharge corotron 36 for removing leftover developer from photoconductive surface 16 and neutralizing residual charges thereon.

Copy sheets 120 are brought forward to transfer station 28 by idler roll 160 and registration and drive roll 150, sheet guides 42, 43 serving to guide the sheet through an approximately 180° turn prior to transfer station 28. Following transfer, the sheet 28 is carried forward to a fusing section 48 where the toner image is fixed by fusing roll 49. Fusing roll 49 is heated by a suitable heater such as lamp 47 disposed within the interior of roll 49. After fixing, the copy sheet 28 is discharged.

A transparent platen 50 supports the document 9 as the document is moved past a scan point 52 by a constant velocity type transport 54. As will be understood, scan point 52 is in effect a scan line extending across the width of platen 50 at a desired point along platen 50 where the document is scanned line by line as the document is moved along platen 50 by transport 54. Transport 54 has input and output document feed roll pairs 55, 56, respectively, on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer 67. As will be understood by those skilled in the art, developer 67 comprises a mixture of larger carrier particles and smaller toner or ink particles. A rotatable magnetic brush developer roll 68 is disposed in predetermined operative relation to the photoconductive surface 16 in developer housing 65, roll 68 serving to bring developer from sump 66 into developing relation with photoreceptor 14 to develop the latent electrostatic images formed on the photoconductive surface 16. All of the machine functions are controlled by conventional controller or microprocessor.

Paper feeder 100 includes copy sheets 120 that are supported in stack-like fashion on base 144 of copy sheet supply tray 145. A T-shaped actuator means 146 is loaded in the solid line position of FIG. 3 against the topmost copy sheet 120 in the stack of sheets 147 in operative relationship with non-rotating feed rolls 149. Feed rolls 149 are hand manipulated to feed the topmost copy sheet to a point where it can be hand manipulated into the nip of the registration roll pair which registers the copy sheets with the image on the photoconductive surface 16 of photoreceptor 15. Registration roll pair 150, 160 advance the copy sheet to transfer station 28. There, suitable transfer/detack means such as transfer/detack corotrons 29, 30 bring the copy sheet into transfer relation with the developed image on photoconductive surface 16 and separate the copy sheet therefrom for fixing and discharge as a finished copy.

Paper feeder 100 comprises a heated copy sheet supply tray 145 with copy sheets 120 positioned therein and supported in stack-like fashion on base 144. Heating of the tray maintains dryness of the sheets as well as prevents curl from setting up in the sheets. A T-shaped, two-position actuator means 146 is positioned above the copy sheets and slidably attached to a rail 178 by means of dove-tail member 177 for movement forwards and backwards over the sheet stack by a handle 148. The actuator means 146 includes feed means 149 on opposite extremities and is controlled by a conventional cam 176 such that when handle 148 is in a first position, (FIG. 4*a*) the actuator means is removed from the top of the sheet stack and when handle 148 is in a second position (FIG. 4*c*), the actuator means is loaded against the topmost copy sheet 120 in the stack of sheets 147 into operative relationship with non-rotating feed means or feed rolls 149. Feed rolls 149 are hand manipulated by pulling handle 148 in a forward direction away from the front of the machine in order to feed the topmost copy sheet to a point where it can be hand manipulated into the nip of the registration roll pair 150, 160 which registers the copy sheet with the image on the photoconductive surface 16 of the photoreceptor. Registration roll pair 150, 160 advances each copy sheet to transfer station 28. Return of handle 148 to its first or rest position causes the actuator means to come into contact with cam 176 and be lifted thereby away from the top of the stack and not make frictional contact with the top sheet of the sheets remaining in the stack during return of the handle to its first position. The feed rolls can be hand manipulated in order to present a fresh copy sheet as use requires. A membrane 141 having a slot therein is located in openable, two position front cover 142 of tray 145. The membrane serves to prevent contaminants from entering the tray.

Copy sheet tray 145 has a second compartment 143 that is used to store copy sheets for later use in placement onto base 144 for feeding by actuator means 146. Replenishment of copy sheets into copy sheet tray 145 is quick and easy for a number of reasons. First, the tray is tilted about 20 degrees with respect to a horizontal plane. This allows copy sheets to settle against the back of the copy sheet tray due to gravity while simultaneously inhibiting multifeeding. In loading a fresh supply of copy sheets into the tray, cover 142 is opened and, if necessary, with two hands copy sheets are placed onto base 144 and cover 142 is closed. The positioning angle of tray 145 enhances the feeding of single copy sheets therefrom since gravity is being used to inhibit multifeeding.

In operation, a document is inserted into machine 8 in the direction of arrow A. The document advances to a point an stops for the insertion of a copy sheet. An operator then pulls on handle 148 which is connected to the actuator and feed rolls via a rod. The actuator falls from its storage position placing the feed rolls onto the copy sheets as the pulling motion is continued. When the actuator falls onto the copy sheets, the shock applied to the top sheet provides sheet separation and because the copy sheets are placed in the tray at an angle, in this case 20°, gravity retards the remaining sheets. The amount of actuator downward force onto the copy sheets is provided by the effects of gravity and the weight of the actuator assembly. The pulling motion of the feed rolls of the actuator moves the copy sheet about 4–6" out of the tray and after the copy sheet is removed by the operator or in the case of a direct feed into a drive wheel device which is a part of the machine, the operator pushes the handle back to the start position, so that it is ready for the next feed. Since the feed rolls are off of the copy sheets when not in use, loading or changing of copy sheets is not hindered by the presence of the actuator in the tray. The copy sheet is then inserted into the nip of the registration roll pair as shown by arrow B. The microprocessor starts the document and copy sheet in synchronism with each other with the document traveling in the direction of arrow A and the copy sheet traveling in the direction of arrow B as shown in FIG. 1. This process is repeated as necessary for the number of copies required.

It should now be understood that a cost effective device for the feeding of sheets from a feed tray has been disclosed that simple, low cost, hand operated or electrically driven for use in a heated media chamber that allows the media to exit the tray through a membrane. The paper feeder includes a slide, handle/rod, lift bracket and T-shaped actuator with feed means as a part thereof. The chamber is tilted about 20° with respect to a horizontal plane for ease of loading as well as for inhibiting multifeeding.

While the invention has been described with reference to the structure shown, it is not confined to the specific details set forth, but is intended to cover such modifications or changes as may come within the scope of the following claims.

What is claimed is:

1. A simple, low cost, hand operated paper feeder, comprising: a media chamber having a stack of media therein and a front and rear end and mounted at an acute angle with respect to a horizontal plane in order to use gravity to register the media therein against said rear end thereof and to provide a retarding force to media exiting said media chamber, said media chamber including an opening in said front end thereof that allows media to exit therethrough; two position, T-shaped actuator means positioned within said media chamber and adapted for movement from a first position removed from the media within said media chamber to a second position contacting said media, and wherein said actuator means includes a pair of non-rotating friction means mounted thereon for contacting said media when said actuator means is in said second position, rail means for slidably supporting said actuator means; a rod member connected to said actuator means and extending outside said front end of said media chamber such that movement of said rod member in a first direction also moves said actuator means to move from said first position to said second position with said friction means contacting said media and wherein continued movement of said rod member in said first direction causes a top sheet of said media to be moved by said friction means a predetermined amount through said opening in said media chamber, and lifting means positioned such that return movement of said rod means in a second and opposite direction toward its initial position moves said actuator means into contact with said lifting means whereby said actuator means is retracted from said media surface to said first position.

2. The paper feeder of claim 1, wherein said friction means comprises hollow, cylindrical rubber rolls.

3. The paper feeder of claim 2, including means for heating said media chamber.

4. The paper feeder of claim 2, wherein said acute angle of said media chamber with respect to a horizontal plane is about 20°.

5. A simple, low cost, hand operated paper feeder, comprising: a media chamber mounted at an acute angle with respect to a horizontal plane that allows media to exit through a slit; two position actuator means positioned within said media chamber and adapted for movement from a first position removed from the media within said media chamber to a second position contact said media, and wherein said actuator means includes a pair of non-rotating friction means mounted thereto for contacting said media when said actuator means is moved from said first position to said second position, means for slidably supporting said actuator means; and means connected to said actuator means for moving said actuator means in a first direction, such that the movement of said means connected to said actuator means in said first direction also moves said actuator means to said second position with said friction means contacting said media and wherein continued movement of said means connected to said actuator means in said first direction causes a top sheet of said media to be moved by said friction means a predetermined amount through said slit; and wherein lifting means for lifting said actuator means into said first position is positioned such that return movement of said means connected to said actuator means in a second and opposite direction causes said actuator means to contact said lifting means and is thereby retracted from said media surface to said first position.

6. The paper feeder of claim 5, wherein said friction means comprises hollow, cylindrical rubber rolls.

7. The paper feeder of claim 6, including means for heating said media chamber.

8. The paper feeder of claim 7, wherein said acute angle of said media chamber with respect to a horizontal plane is about 20°.

9. The paper feeder of claim 8, wherein said means for slidably supporting said actuator means is a rail positioned above media within said media chamber.

10. The paper feeder of claim 9, wherein said media chamber includes a copy sheet storage area.

11. In a hand operated paper feeder, the improvement, comprising: media chamber mounted at an acute angle with respect to a horizontal plane and enclosed except for an opening therein for media to exit said chamber, said media chamber including at least two compartments with one of said compartments being adapted for media storage and another of said compartments being adapted for support of in-use media and feed means.

12. The paper feeder of claim 11, wherein said acute angle of said media chamber with respect to a horizontal plane is about 20°.

13. The paper feeder of claim 11, wherein said opening in said media chamber is covered by a membrane with a slit therein, said membrane being adapted to allow media to pass through said slit while simultaneously keeping contaminants out of said media chamber.

14. The paper feeder of claim 11, including means for heating said media chamber.

* * * * *